US006839914B2

(12) United States Patent
Shiozaki et al.

(10) Patent No.: US 6,839,914 B2
(45) Date of Patent: Jan. 11, 2005

(54) SUIT

(75) Inventors: Katsuhiko Shiozaki, Osaka (JP); Takahiro Kiuchi, Osaka (JP)

(73) Assignee: La Sara Co., Ltd., Osaka (JP)

( * ) Notice: Subject to any disclaimer, the term of this patent is extended or adjusted under 35 U.S.C. 154(b) by 29 days.

(21) Appl. No.: 10/280,039

(22) Filed: Oct. 25, 2002

(65) Prior Publication Data

US 2003/0084497 A1 May 8, 2003

(30) Foreign Application Priority Data

Nov. 2, 2001 (JP) ..... 2001-338266

(51) Int. Cl.[7] ..... A41D 27/24
(52) U.S. Cl. ..... 2/227; 2/275
(58) Field of Search ..... 2/227, 79, 69, 2/231, 232, 233, 234, 235, 409, 242, 275, 114, 78.1, 243.1; 66/177; D2/732

(56) References Cited

U.S. PATENT DOCUMENTS 198,299 A * 12/1877 Henning ..... 2/227
541,334 A * 6/1895 Roschi ..... 2/227
1,405,405 A * 2/1922 Gendel ..... 2/80
1,861,704 A * 6/1932 Manke ..... 2/227
1,885,527 A * 11/1932 Luft ..... 2/227
2,316,588 A * 4/1943 Isaacs ..... 2/227
3,329,966 A * 7/1967 Slavick ..... 2/2.15
3,763,498 A * 10/1973 Rector ..... 2/2.15
3,938,196 A * 2/1976 Zaoui ..... 2/227
4,215,435 A * 8/1980 Miele ..... 2/227
4,368,547 A * 1/1983 dePolo ..... 2/409
D273,434 S * 4/1984 Galbreath ..... D2/742
4,509,213 A * 4/1985 Harvey ..... 2/22
4,532,657 A * 8/1985 Revene ..... 2/409
4,625,336 A * 12/1986 Derderian ..... 2/79
4,651,353 A * 3/1987 Walden ..... 2/227
5,219,367 A * 6/1993 Fields ..... 2/227
5,282,277 A * 2/1994 Onozawa ..... 2/69
D370,552 S * 6/1996 Erwin et al. ..... D2/742
5,689,832 A * 11/1997 Head ..... 2/227
5,768,703 A * 6/1998 Machado et al. ..... 2/2.15
5,943,699 A * 8/1999 Barbeau ..... 2/81
D418,276 S * 1/2000 Bengtsson ..... D2/732
6,243,879 B1 * 6/2001 Lyden ..... 2/227
6,286,150 B1 * 9/2001 Miller et al. ..... 2/232
6,421,831 B1 * 7/2002 Korff ..... 2/69
D461,033 S * 8/2002 Fairhurst et al. ..... D2/732
D461,034 S * 8/2002 Fairhurst et al. ..... D2/732
6,446,264 B2 * 9/2002 Fairhurst et al. ..... 2/69

* cited by examiner

*Primary Examiner*—John J. Calvert
*Assistant Examiner*—Alissa L. Hoey
(74) *Attorney, Agent, or Firm*—Keating & Bennett, LLP

(57) ABSTRACT

A suit that has excellent comfort during regular wearing and while using a wheelchair includes a top having a back body having a left half back body and a right half back body, a back body center joint line for constituting a back seam and located at a center of the back body, a left back body dividing seam line for dividing the left half back body in a middle portion in its width direction and located between the back body center joint line and a side seam of the left half, and a right back body dividing seam line for dividing the right half back body in a middle portion in its width direction and located between the back body center joint line and a side seam of the right half.

10 Claims, 15 Drawing Sheets

66
68
68A
68B
80
90A
90B
94
70A
72a
74a
76
82A
84A
86A
70
70B
72A
78
92B
96
82B
84B
86B
72b
74b
72B
92A 68A
80
S
O
Q
94

70A
86A
R
80
82A
84A
P
N
96

70A
86A
R
J
M
80
K
L
D
C
84A
82A
A
B
E
F1
F2
G
88A
H
I
96

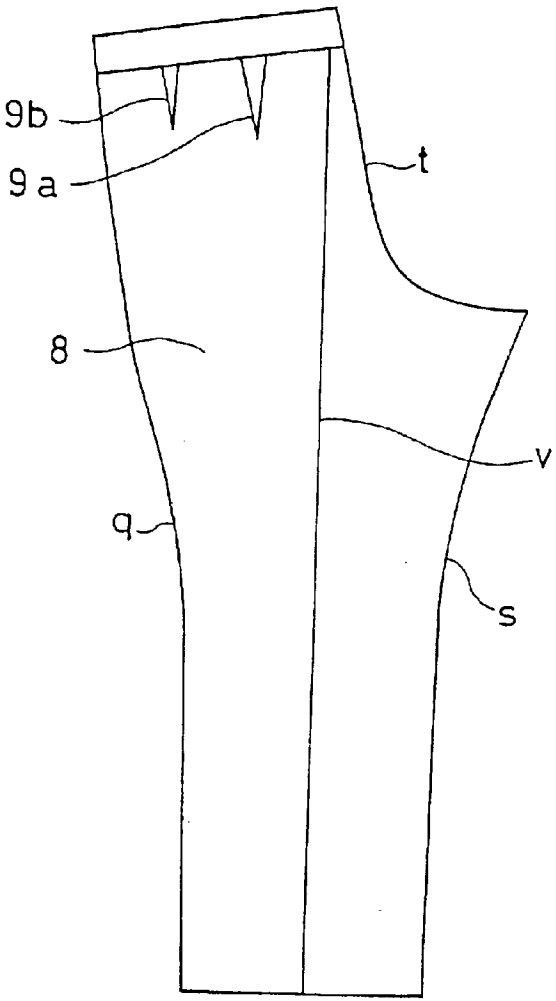
Fig. 20 (B) PRIOR ART
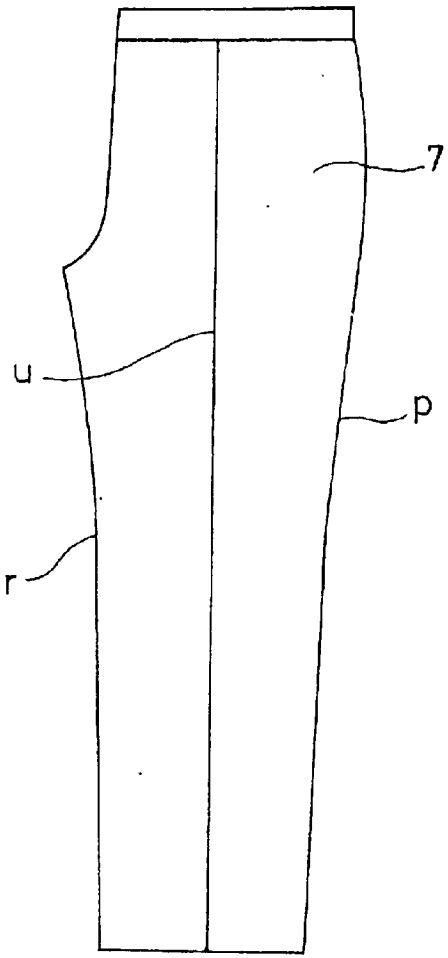
Fig. 20 (A) PRIOR ART

SUIT

BACKGROUND OF THE INVENTION

1. Field of the Invention

The present invention relates to a suit, in particular, a suit such as a business suit and a formal suit, which is suitably worn by the people who are obliged to use a wheelchair in daily life.

2. Description of the Prior Art

FIG. 19 is a development view of fabric pieces constituting a left half (left body) of a top of a conventional business suit, which constitutes the background of the present invention. FIGS. 20A and 20B are development views of fabric pieces constituting a left half (left body) of a pair of trousers of a conventional business suit, which constitutes the background of the present invention. FIG. 20A is a diagram of a fabric constituting a left half (left body) of a front body of the trousers, and FIG. 20B is a diagram of a fabric constituting a left half (left body) of a back body of the trousers.

The top of the conventional business suit includes, as shown in FIG. 19, a front body 1, a side body 2, a back body 3, a top sleeve 4 and an under sleeve 5, each of which is cut into a predetermined shape. A line a of the front body 1 is joined to a line b of the side body 2. A line c of the side body 2 is joined to one line d of the back body 3. The other line e of the back body 3 defines a seam line between right and left back bodies, which is to be joined to the right back body. The line e also has the function of modifying the center of the back body which stands out far from the body so as to extend around the back. Lines f and g of the top sleeve 4 are respectively joined to lines i and h of the under sleeve 5 to provide a sleeve having a cylindrical shape. A line j of the front body 1 and a line k of the back body 3 are joined to each other to form a shoulder seam. As a result, a line m of the front body 1 and a line n of the back body 3 are formed to be joined to a sleeve, thereby forming an armhole seam. Furthermore, a bust dart 6 for a prominent breast part and for shaping a waistline is provided in the front body 1.

Since a development view of fabric pieces constituting a right half (right body) of the top has line symmetry with respect to that of the fabric pieces constituting the left half (left body) of the top shown in FIG. 19, the illustration and the description thereof are omitted herein.

The trousers of the conventional business suit include, as shown in FIGS. 20A and 20B, a front body 7 and a back body 8, each of which is cut into a predetermined shape. A line p of the front body 7 is joined to a line q of the back body 8 so as to form a side seam, whereas a line r of the front body 7 is joined to a line s of the back body 8 so as to form an inseam. A line u of the front body 7 forms a front crease while a line v of the back body 8 forms a back crease. Furthermore, back darts 9*a* and 9*b* for rounding a hipline as well as for providing a waist fit are provided in the back body 8.

Since development views of fabric pieces constituting a right half of the front body and a right half of the back body of the trousers have line symmetry with respect to the left half of the front body and the left half of the back body of the trousers shown in FIGS. 20A and 20B, the illustration and the description thereof are herein omitted. A line t of the back body 8 forms a seam line between the left body and the right body (hip seam).

The conventional business suit as shown in FIGS. 19, 20A and 20B is basically fabricated on the basis of the standing position, and is therefore relatively free of problems in terms of the movement functionality and the comfort in wearing the suit while in a standing position.

However, for example, for the people who are obliged to use a wheelchair in daily life, that is, in terms of the movement functionality and the comfort in wearing a suit while in a seated position, such a conventional business suit has various problems and is far from satisfactory.

More specifically, in the top of the conventional business suit as shown in FIG. 19, when a wearer sits in a wheelchair, the abdomen line of the top becomes larger than that at the standing position. Therefore, the tightness around the abdomen does not disappear. Moreover, the back body (back) of the top is stretched when a wearer operates the wheelchair, which makes it extremely hard to manage the wheelchair. Moreover, while in the seated position, the gapping of a crease line (lapel crease line) of the top occurs to open a lapped front. Therefore, such a top looks unattractive and lacking in esthetic values.

In this case, the roundness formed by the line e of the back body 3 serving as a seam line between the left and right back bodies of the top cannot sufficiently follow the movement when a wearer operates the wheelchair. Moreover, shoulder pads are normally provided on the shoulders of a top of a business suit. Such shoulder pads cause resistance against the movement when a wearer operates the wheelchair.

Furthermore, in the case where side vents are provided for a conventional top, a front hem is pulled toward the back side because of insufficient depth and the width of the side vents. As a result, the front hem becomes too long. The sleeves of the top are constituted so as to form the straight sleeve lines while in the standing position. Thus, it is hard to bend the elbows while a wearer is sitting in the wheelchair. Moreover, since the amount of contraction for a sleeve line o is small, the amount of movement of the arms is restricted to be insufficient. Accordingly, such a sleeve is not suitable for operating the wheelchair. In addition, the operation of the wheelchair brings the cuffs into contact with a push rim or a wheel which frequently causes the cuffs to become dirty or damaged.

On the other hand, since there is little difference between a front crotch length and a back crotch length of the trousers of the conventional business suit as shown in FIGS. 20A and 20B, a buttock line is insufficient. As a result, at the sitting position, a belt on the top of the back body is downwardly pulled to slip down while a belt on the top of the front body rides up. In such a case, the front body becomes too long while the back body becomes too short so as to expose the back.

Furthermore, the trousers of the conventional business suit are formed so as to provide an esthetic appearance and characteristics while in the standing position. As a result, the hipline and the buttock line become larger at the sitting position than at the standing position. Therefore, the hip part and the buttock part closely fit to the body so that the trousers become too tight around the hipline and the buttock line. Moreover, since knee parts of conventional trousers are formed so as to be approximately horizontal while in the standing position, the knee parts are stretched when a wearer sits in a wheelchair, making it difficult to bend the knees.

Moreover, since front hems of the conventional trousers are formed so as to be approximately horizontal while in the standing position, the front hems ride up while a wearer sits in the wheelchair for a long time. As a result, the ankles are exposed to cause an awkward appearance.

Various problems as described above are due to the fact that the conventional business suit shown in FIGS. 19, 20A and 20B cannot smoothly respond to/follow the movement while in the sitting position when using the wheelchair.

On the other hand, the inventors of the present invention have earnestly strived to study and develop a business suit or formal suit that is comfortable in regular wearing and while operating a wheelchair, so as to encourage the people who are wheelchair users to positively participate in social life. As a result, the inventors of the present invention have succeeded in solving the above-described various problems, while achieving significant advantages and improvements to such a suit.

SUMMARY OF THE INVENTION

In order to overcome the problems described above, preferred embodiments of the present invention provide a suit that has excellent comfort during wearing and operation of a wheelchair.

According to a preferred embodiment of the present invention, a suit includes a top having a back body having a left half back body and a right half back body, a back body center joint line for constituting a back seam and located at the approximate center of the back body, a left back body dividing seam line for dividing the left half back body in a middle portion of the left half back body in its width direction and located between the back body center joint line and a side seam of the left half, and a right back body dividing seam line for dividing the right half back body in a middle portion of the right half back body in its width direction and located between the back body center joint line and a side seam of the right half.

Each of the left back body dividing seam line and the right back body dividing seam line is preferably arranged so that at least a part thereof approximately runs along a shoulder blade of a wearer.

One end of each of the left back body dividing seam line and the right back body dividing seam line preferably extends to a shoulder seam while the other end extends to a back body hem line.

The suit may also include a sleeve having a cuff that can be opened and closed by a hook and loop fastener.

It is preferred that the suit does not have shoulder pads.

The suit also preferably includes a pair of trousers including a back body, and a knee portion dividing seam line for allowing a knee portion of the back body to be bent while in a standing position and located at a position corresponding to a knee joint of the back body, wherein a part of the back body situated above the knee portion dividing seam line is partitioned into a plurality of sections by a curved joint line.

Also, the part of the back body situated above the knee portion dividing seam line is preferably partitioned into at least four sections by a plurality of joint lines.

Further, one end of the knee portion dividing seam line preferably reaches a side seam of the back body and the other end reaches an inseam of the back body.

It is preferred that the trousers have a hip seam that is slanted and a back crotch length is longer than a front crotch length.

The trousers having a front body sewn to the back body preferably have a hem front center of the front body of the trousers that is situated under a hem back center of the back body.

It is also preferred that a side pocket and/or a back pocket is not provided.

Since a back body (back) is constituted by joining fabric pieces at the positions of a back body center joint line, a left back body dividing seam line and a right back body dividing seam line, the entire back body (back) is constructed to have the desired roundness. Therefore, when a wearer of the top of the suit sits in a wheelchair, the roundness of the back is enveloped by the top, providing excellent comfort for the wearer. Furthermore, since the top is excellent in terms of the movement functionality of responding to/following the movement of the elbows and the shoulders when a wearer operates a wheelchair, the tension in the back is reduced as compared with the case where a wearer is wearing a conventional suit, thereby allowing a necessary amount of movement to be ensured.

Also, since at least parts of the left back body dividing seam line and the right back body dividing seam line are preferably arranged so as to approximately run along the shoulder blades of a wearer, the rotational movement of the elbows and the shoulders becomes smooth when a wearer operates the wheelchair.

Further, since one end of each of the left back body dividing seam line and the right back body dividing seam line reaches a shoulder seam and the other end thereof reaches a back body hem line, the roundness of the entire back body (back) can be sufficiently obtained as compared with the case where these ends do not reach the shoulder seam and the back body hem line. Therefore, the movement functionality can be further improved when a wearer operates the wheelchair.

Also, as a result of a sleeve having a cuff that can be opened and closed by a hook and loop fastener, it is possible to roll the cuff up to hold it by the hook and loop fastener. Thus, when a wearer rotates a push rim of the wheelchair, the cuff does not become an obstacle, and therefore does not get caught around the wheel. Moreover, the edge of the cuff can be prevented from being damaged due to rubbing against the push rim.

Further, since no shoulder pads are provided, the top is reduced in weight. At the same time, a resistance against the movement of the shoulders when a wearer operates the wheelchair is eliminated.

Also, since a knee portion dividing seam line is provided in the back body, a knee portion of the back body is in a bent state while in the standing position. Therefore, the excess ease at the knee can be eliminated when a wearer sits in the wheelchair. Furthermore, since a part of the back body which is situated above the knee portion dividing seam line is partitioned into a plurality of sections by a curved joint line, a three-dimensional space, in figurative terms, having paper balloon-like roundness can be ensured from the hipline to the buttock line. Therefore, when a wearer sits in the wheelchair, the buttock line does not closely fit to the body, allowing a sitting position to be maintained with fullness.

In addition, as a result of the part of the back body which is situated above the knee portion dividing seam line preferably being partitioned into at least four sections by a plurality of joint lines, it is further possible to form a round structure from the hipline to the buttock line. As a result, a sitting position is further improved in fullness.

Since one end of the knee portion cutting line preferably extends to a side seam whereas the other end extends to an inseam, a large bent angle of the knee portion while in the standing position can be ensured. Therefore, the excess ease of the knee at the sitting position can be further eliminated.

Because a hip seam of the trousers is preferably slanted, and a front crotch length is longer than a back crotch length, a comfortable sitting position is provided for. In this case, since the buttock line has the desired allowance, a front hem does not become too long to expose the back under the top even if a wearer sits in the wheelchair for a long time.

Since a hem front center of a front body of the trousers is preferably located under a hem back center of a back body of the trousers, a front hem does not ride up, providing a good appearance.

Also, as a result of a side pocket and/or a back pocket not being provided for the trousers, an overlapping portion of fabric pieces such as an upper binding, a lower binding, a patch and overlapped seam becomes as small as possible at the positions where these pockets are otherwise provided. Therefore, as compared with the case where these pockets are provided, the ventilation is improved in the regions where a side pocket and/or a back pocket are to be provided and the vicinity thereof. At the same time, a undesirably tight fit between these pockets and the body can be alleviated. Thus, even if a wearer sits in the wheelchair for a long time, pressure sores can be prevented.

The above-described and other elements, features, characteristics and advantages will be further apparent from the following detailed description of preferred embodiments of the present invention with reference to the accompanying drawings.

BRIEF DESCRIPTION OF THE DRAWINGS

FIG. 1A is a front diagram and FIG. 1B is a back diagram;

FIG. 3A is a development view showing fabric pieces constituting a top sleeve and an under sleeve, and FIG. 3B is a right side diagram thereof;

FIG. 4A is a front diagram, and FIG. 4B is a back diagram thereof;

FIG. 5A is a diagram of a main part showing the cuff part in a closed state, and FIG. 5B is a diagram of a main part showing the cuff part in an open state;

FIG. 7A is a front diagram, FIG. 7B is a left side diagram, and FIG. 7C is a back diagram;

FIG. 8A is a diagram showing a fabric constituting a left half (left body) of a front body of the trousers, FIG. 8B is a diagram showing a fabric constituting a left half (left leg) of a back body of the trousers, and FIG. 8C is an exploded view of FIG. 8B;

FIG. 9A is a diagram of a main part showing a sewing method by open seam, and FIG. 9B is a diagram of a main part showing a sewing method by overlapped seam;

FIG. 10A is a diagram of a main part showing a cut edge treatment by an overlock sewing machine, and FIG. 10B is a diagram of a main part showing a cut edge treatment by piping;

FIGS. 20A and 20B are development views showing fabric pieces constituting a left half (left body) of a pair of trousers of a conventional business suit, constituting the background of the present invention, where FIG. 20A is a diagram showing a fabric constituting a left half (left body) of a front body of the trousers, and FIG. 20B is a diagram showing a fabric constituting a left half (left body) of a back body of the trousers.

DETAILED DESCRIPTION OF PREFERRED EMBODIMENTS

Figure 1:
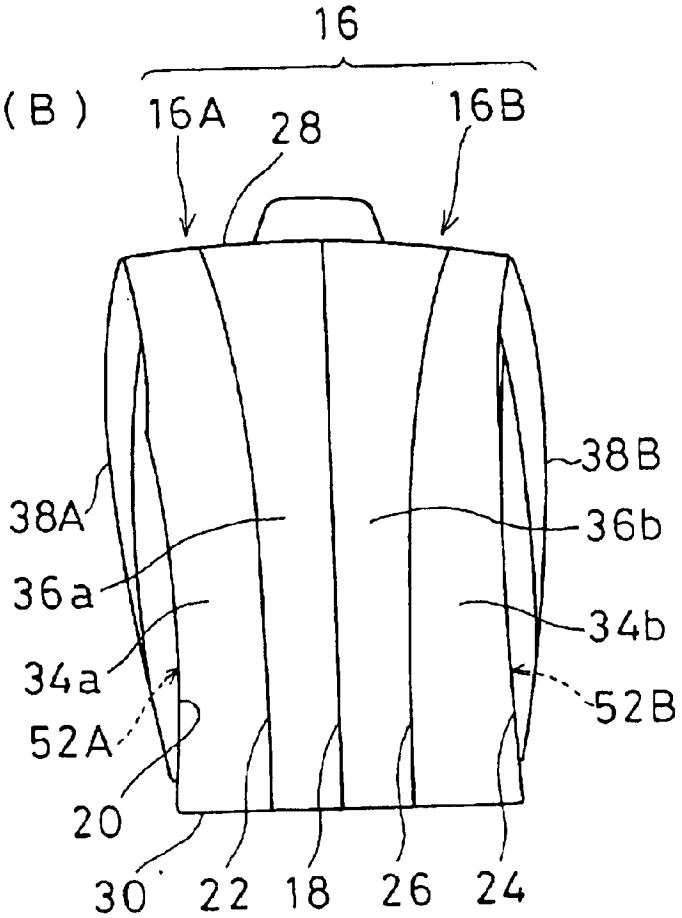
FIGS. 1A and 1B are diagrams showing an example of a top according to a preferred embodiment of the present invention, where
Figure 1:
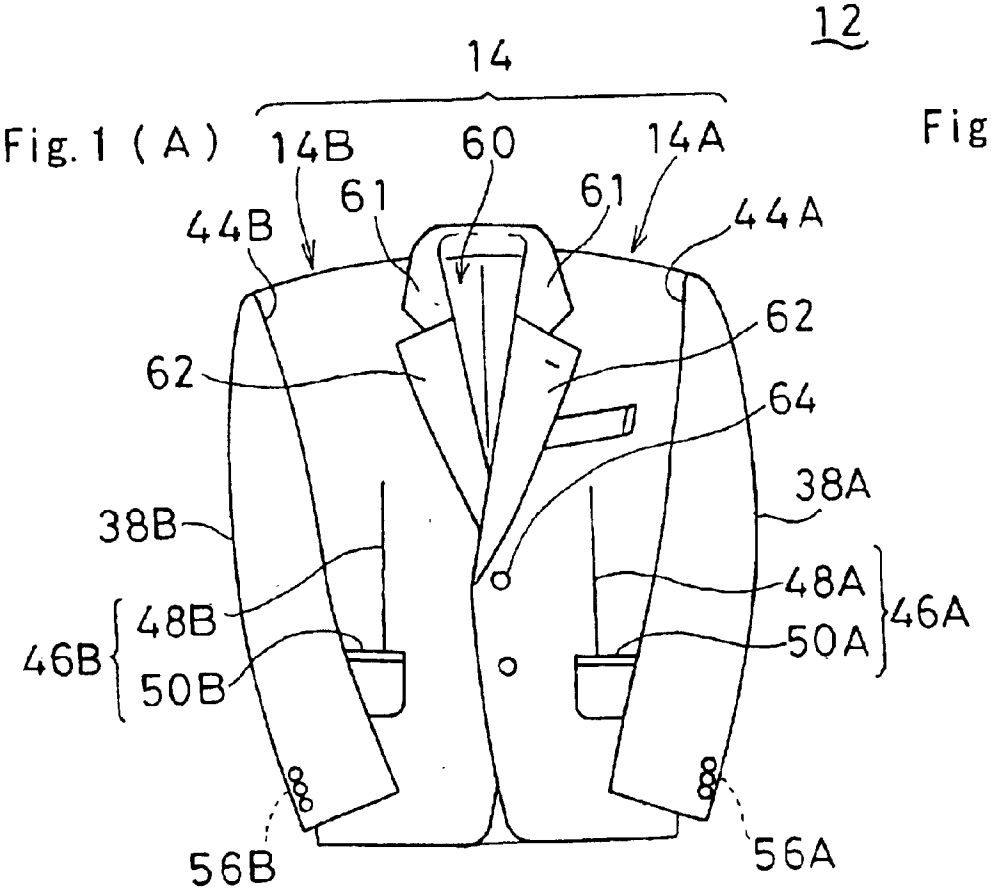

In this preferred embodiment, for example, a top and a pair of trousers of a men's business suit will be particularly described. First, the top will be described with reference to FIG. 1A to FIG. 6 and FIG. 9A to FIG. 11.

FIGS. 1A and 1B are diagrams showing an example of a top according to a preferred embodiment of the present invention. FIG. 1A is a front diagram and FIG. 1B is a back diagram thereof.

A business suit 1 according to this preferred embodiment includes a top 12. The top 12 includes a front body 14 and a back body 16. The front body 14 includes, as shown in FIG. 1A, a front body 14A of a left half (hereinafter, referred to simply as the left front body 14A) and a front body 14B of a right half (hereinafter, referred to simply as the right front body 14B). The back body 16 includes, as shown in FIG. 1B, a back body 16A of a left half (hereinafter, referred to simply as the left back body 16A) and a back body 16B of a right half (hereinafter, referred to simply as the right back body 16B).

In the back body 16 of the top 12, a longitudinally extending back body center joint line 18, which is preferably located at the approximate center in a width direction of the back body, is provided. The back body center joint line 18 is constituted as a back seam (seam line of the left and right back bodies). Furthermore, in the back body 16 of the top 12, a longitudinally extending left back body dividing seam line 22, which is preferably located between the back body center joint line 18 and a side seam 20 of the left body, is provided. A longitudinally extending right back body dividing seam line 26 is provided between the back body center joint line 18 and a side seam 24 of the right body. In this case, the side seam 20 of the left body represents a seam line between a left side body and a left back body, whereas the side seam 24 of the right body represents a seam line between a right side body and a right back body.

Each of the left back body dividing seam line 22 and the right back body dividing seam line 26 is arranged so that its one end extends to a shoulder seam 28 and the other end extends to a back body hem line 30. The left body dividing seam line 22 and the right body dividing seam line 26 respectively divide the left back body 16A and the right back body 16B in the middle portion in their width direction. Each of the left back body dividing seam line 22 and the right back body dividing seam line 26 is arranged so that at least a part thereof approximately runs along the shoulder blade.

Figure 2:
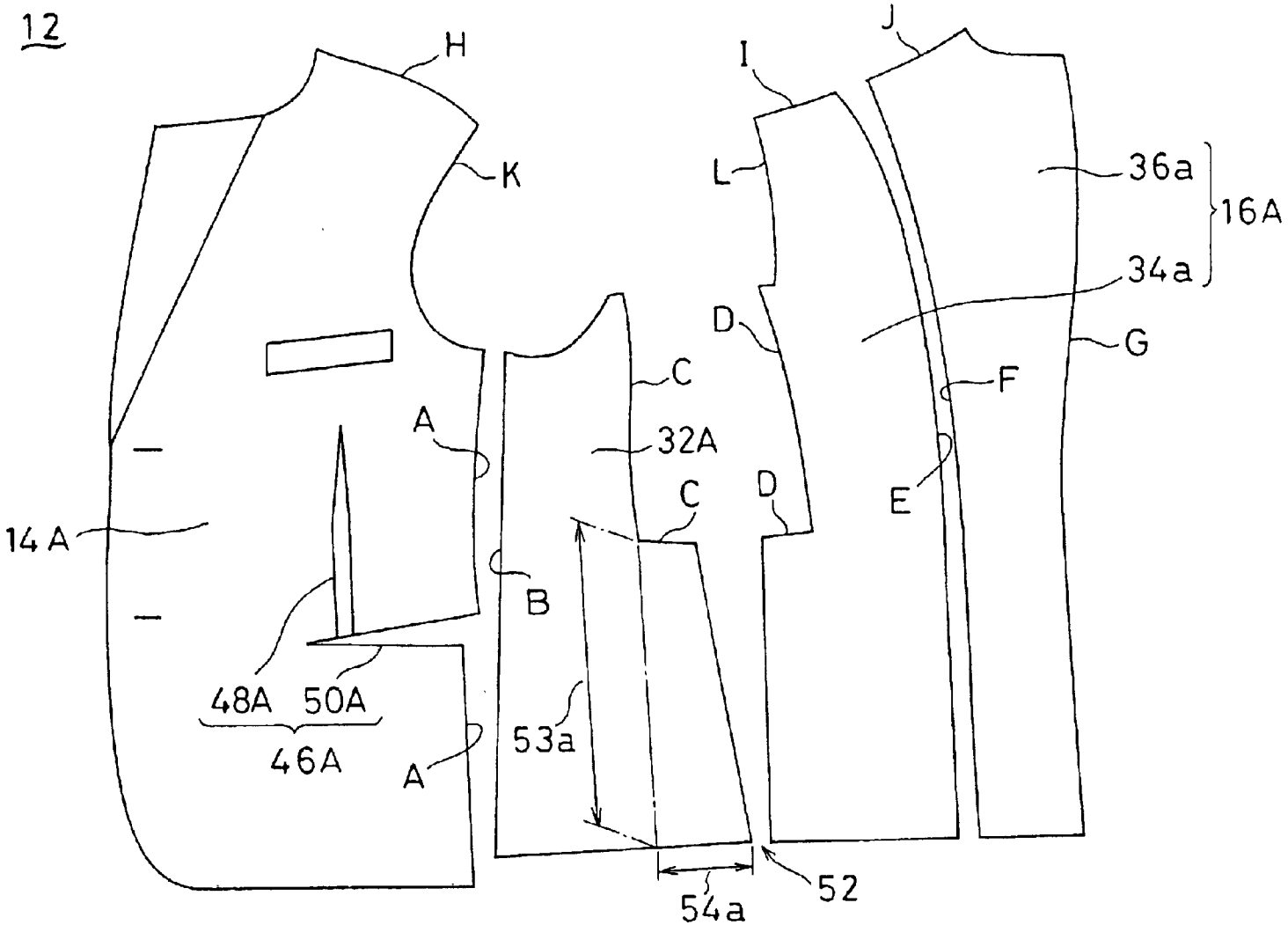
FIG. 2 is a development view showing fabric pieces constituting a main part of a left half (left body) of the top shown in FIGS. 1A and 1B.
Figure 3:
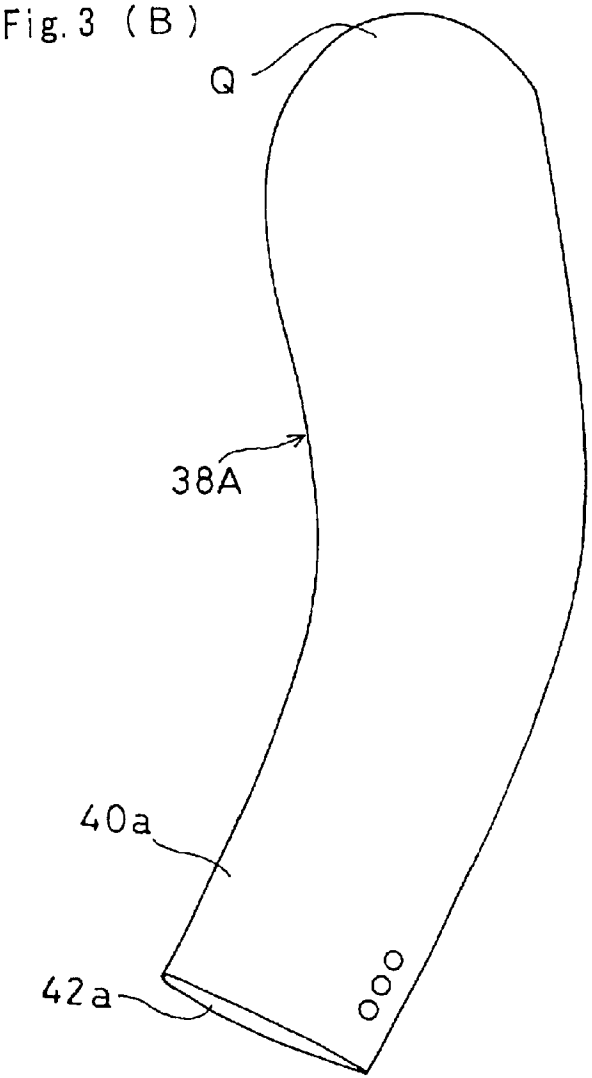
FIGS. 3A and 3B are diagrams showing a left sleeve of the top shown in FIGS. 1A and 1B, where
Figure 3:
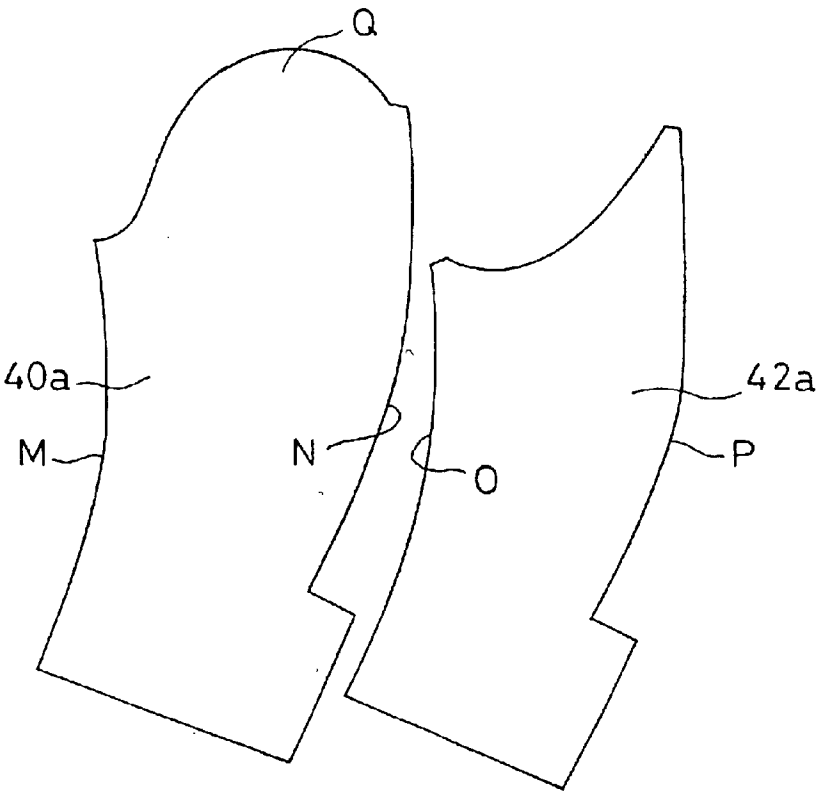
Figure 4:
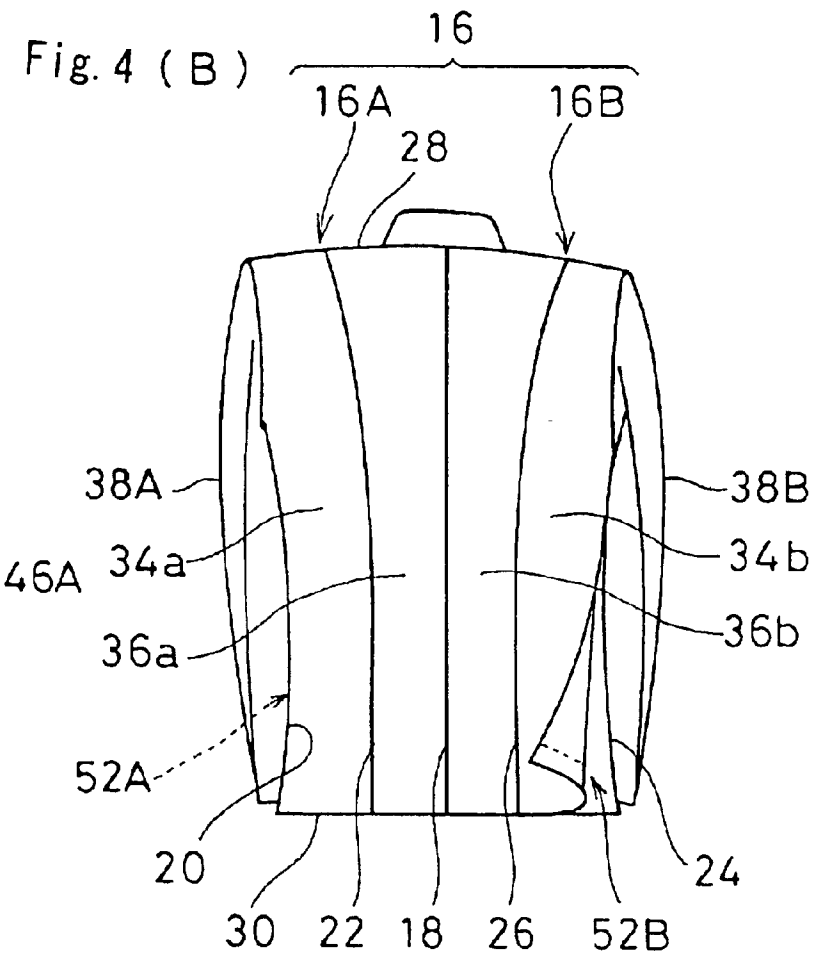
FIGS. 4A and 4B are diagrams showing a main part of the top shown in FIGS. 1A and 1B, where
Figure 4:
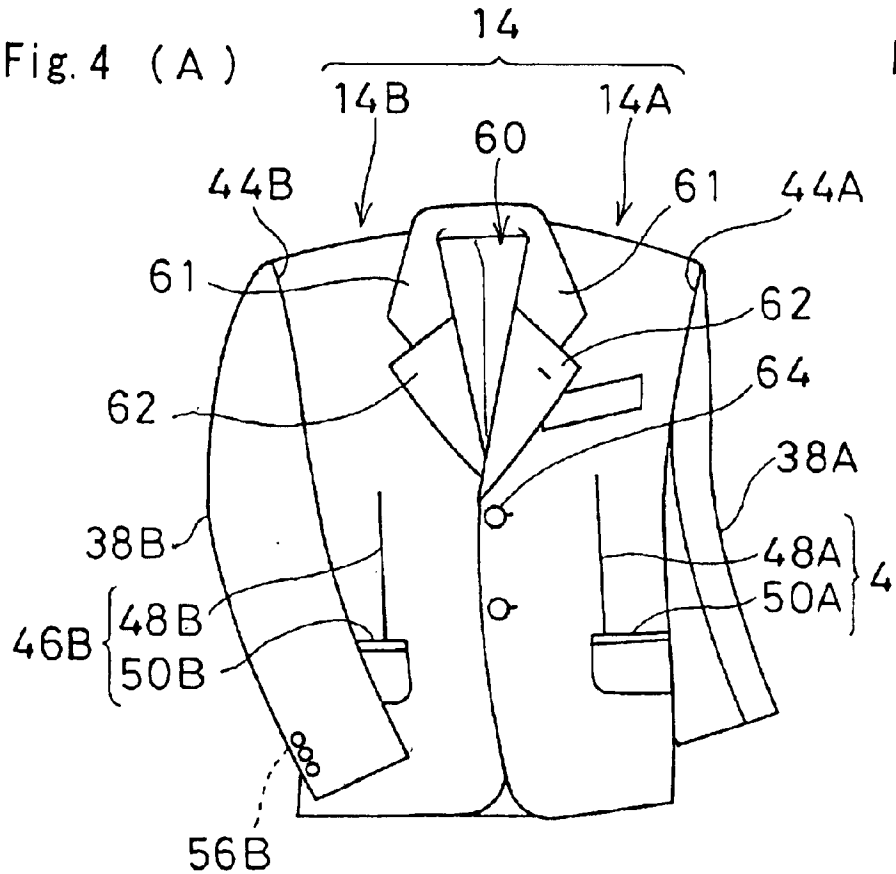
Figure 5:
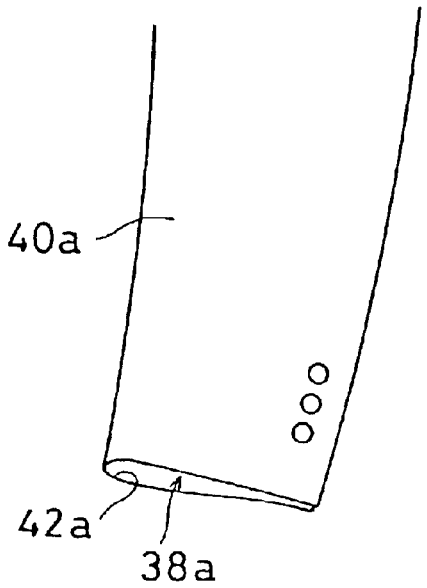
FIGS. 5A and 5B are diagrams showing another main part (cuff part) of the top shown in FIGS. 1A and 1B, where
Figure 5:
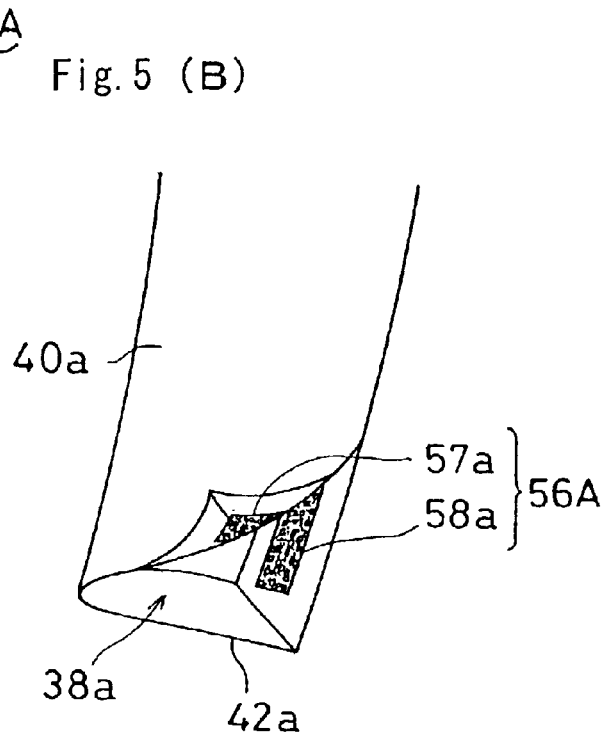

FIG. 2 is a development view of fabric pieces showing a main part of the left half (left body) of the top 12 shown in FIGS. 1A and 1B. Since the development diagram of fabric pieces constituting a right half (right body) of the top 12 has line symmetry with respect to that of the fabric pieces of the left half (left body) shown in FIG. 2, the illustration and the description thereof are herein omitted.

The left half of the top 12 includes, for example as shown in FIG. 2, and FIGS. 3A and 3B, a left front body 14A, a left side body 32A, a left back body 16A, and a top sleeve 40*a* and an under sleeve 42*a* of a left sleeve 38A, each of which is cut into a predetermined shape. The left back body 16A includes a first left back body 34*a* and a second left back body 36*b*.

A line A of the front body 14A is joined to a line B of the side body 32A. A line C of the side body 32A is joined to a line D of the first left back body 34*a*. A line E of the first left back body 34*a* is joined to a line F of the second left back body 36*a*. A line G of the second left back body 36*a* is joined to the right back body 16B to form a back seam line (seam line between the left and right back bodies).

A line H of the front body 14A is joined to a line I of the first left back body 34*a* and a line J of the second left back body 36*a* to form a line of the shoulder seam 28.

At the same time, a line K of the front body 14A and a line L of the first left back body 34*a* are arranged to be joined to a sleeve, thereby defining an armhole seam 44A of the left half.

For example as shown in FIG. 3A, lines M and N of the top sleeve 40*a* are respectively joined to lines P and O of the under sleeve 42*a* so as to provide the left sleeve 38A of the top 12 with a substantially cylindrical shape. As an example of a sewing method (sewing treatment) at the joints of the lines M and N to the lines O and P, for example, open seam as shown in FIG. 9A may be performed.

In this case, a large amount of contraction is provided for a line Q of the sleeve 38A so as to increase the three-dimensional roundness of a shoulder portion, thereby enhancing the movement functionality of the shoulder portion and the elbow portion. Furthermore, the curve angles of the lines M and N and the corresponding lines O and P are relatively large so as to further improve the movement functionality of the elbow portion.

In a similar manner, the sleeve 38B of the left half of the top 12 is formed.

In this preferred embodiment, the line E of the first left back body 34*a* and the line F of the second left back body 36*a* are joined to each other to form the left back body dividing seam line 22 shown in FIG. 1B. Then, the line G of the second left back body 36*a* and the right back body 16B are joined to each other to form the back body center joint line 18. In a similar manner, a first right back body 34*b* and a second right back body 36*b* are defined by a right back body dividing seam line 26 in the right back body of the right half (right body) of the top 12.

As an example of a sewing method (sewing treatment) for the back body center joint line 18, the left back body dividing seam line 22 and the right back body dividing seam line 26, for example, an open seam as shown in FIG. 9A, may be performed. As seam finishing for a cut edge, for example, piping as shown in FIG. 10B may be performed.

In this preferred embodiment, the left front body 14A has a manipulation part 46A. The manipulation part 46A includes a bust dart portion 48A. A waist dart portion 50A, which straightly extends from the lower end of the bust dart portion 48A to the line A of the left front body 14A, is provided. The bust dart portion 48A and the waist dart portion 50A are arranged so as to significantly eliminate the excess fabric around the abdomen to give the roundness around the abdomen of the top 12, thereby providing the desired fullness. In a similar manner, the right front body 14B has a manipulation part 46B constituted by a bust dart portion 48B and a waist dart portion 50B.

In this preferred embodiment, for example as shown in FIGS. 2 and 4B, a side vent 52A is formed in the left half of the top. The side vent 52A is formed to have a large depth 53*a* and a width 54*a* that is larger than a length of the top of a wearer in accordance with the body shape of the wearer so as to form a large overlapping portion of the side vent 52A. Moreover, the cutting shape used for the side vent is preferably curved. In a similar structure, a side vent 52B is formed in the right half. Accordingly, in this preferred embodiment, a front hem can be prevented from being too long.

In this preferred embodiment, for example, deep slits or box pleats may be provided on the both sides instead of the side vents 52A and 52B. The front length and the total length may be reduced and the deep side vents or slits may be provided on both sides so as to prevent the front hem from being too long.

Figure 6:
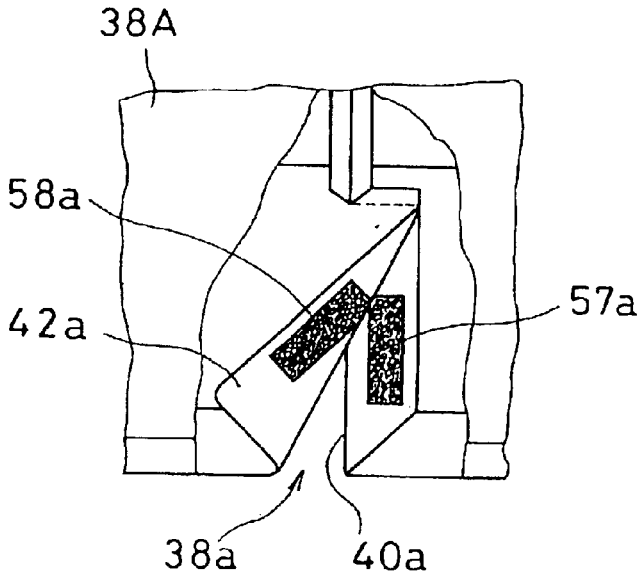
FIG. 6 is a diagram of a main part showing the cuff part shown in FIGS. 5A and 5B, seen from the inside of a sleeve, where a lining is partially torn.

Furthermore, as shown in FIGS. 5A, 5B and 6, in this example, a cuff 38*a* of the left sleeve 38A of the top 12 is attached by a hook and loop fastener 56A so as to allow the free open and close actions of the cuff. In this case, the cuff 38*a* has, for example, a structure of book opening. One fastener surface 57*a* of the hook and loop fastener 56A is provided at the position of the under sleeve 42*a* corresponding to a portion where a button is to be attached, whereas the other fastener surface 58*a* of the hook and loop fastener 56A is provided at the position in a reverse of the top sleeve 40*a* corresponding to a button hole stitch. The fastener surface 57*a* and the other fastener surface 58*a* are arranged so as to oppose to each other.

The fastener surface 57*a* and the other fastener surface 58*a* are respectively attached to the above-described positions preferably by sewing. An ornamental button 59*a* is preferably provided on the surface of the top sleeve 40*a* which is opposite to the other fastener surface 57*a*.

Therefore, in this preferred embodiment, since the sleeves 38A and 38B respectively have the cuffs 38*a* and 38*b* which can be freely opened and closed by the hook and loop fasteners 56A and 56B, it is possible to roll the cuffs 38*a* and 38*b* up to hold them by the hook and loop fasteners 56A and 56B. As a result, when a wearer rotates a push rim of the wheelchair, the cuffs 38*a* and 38*b* are neither obstructive nor caught around the wheel. Moreover, the edges of the cuffs 38*a* and 38*b* can be prevented from being damaged due to rubbing against a push rim of the wheelchair.

With the similar placement and structure, the hook and loop fastener 56B having a male piece 57*a* and a female piece 58*b* is provided on the cuff 38*b* of the right sleeve 38B of the top 12.

Although the hook and loop fasteners 56A and 56B are preferably provided at the above-described predetermined positions by sewing in this preferred embodiment, the hook and loop fasteners 56A and 56B may be adhered to the predetermined positions through, for example, an adhesive.

Furthermore, for example, as shown in FIGS. 1A and 4A, the top 12 is formed to have a rather small, substantially V-shaped zone 60 so as to prevent a neck having a collar 61 and a lapel 62 from being opened in this preferred embodiment. In this case, a first button 64 is attached at a high position so as to reduce the substantially V-shaped zone 60.

In a conventional business suit, the gapping of a crease line (lapel crease line) occurs at the sitting position. As a result, the lapped front is opened to impair the appearance. In this preferred embodiment, however, such a disadvantage does not occur.

Furthermore, no shoulder pad is provided for the top 12 in this preferred embodiment of the present invention.

Figure 7:
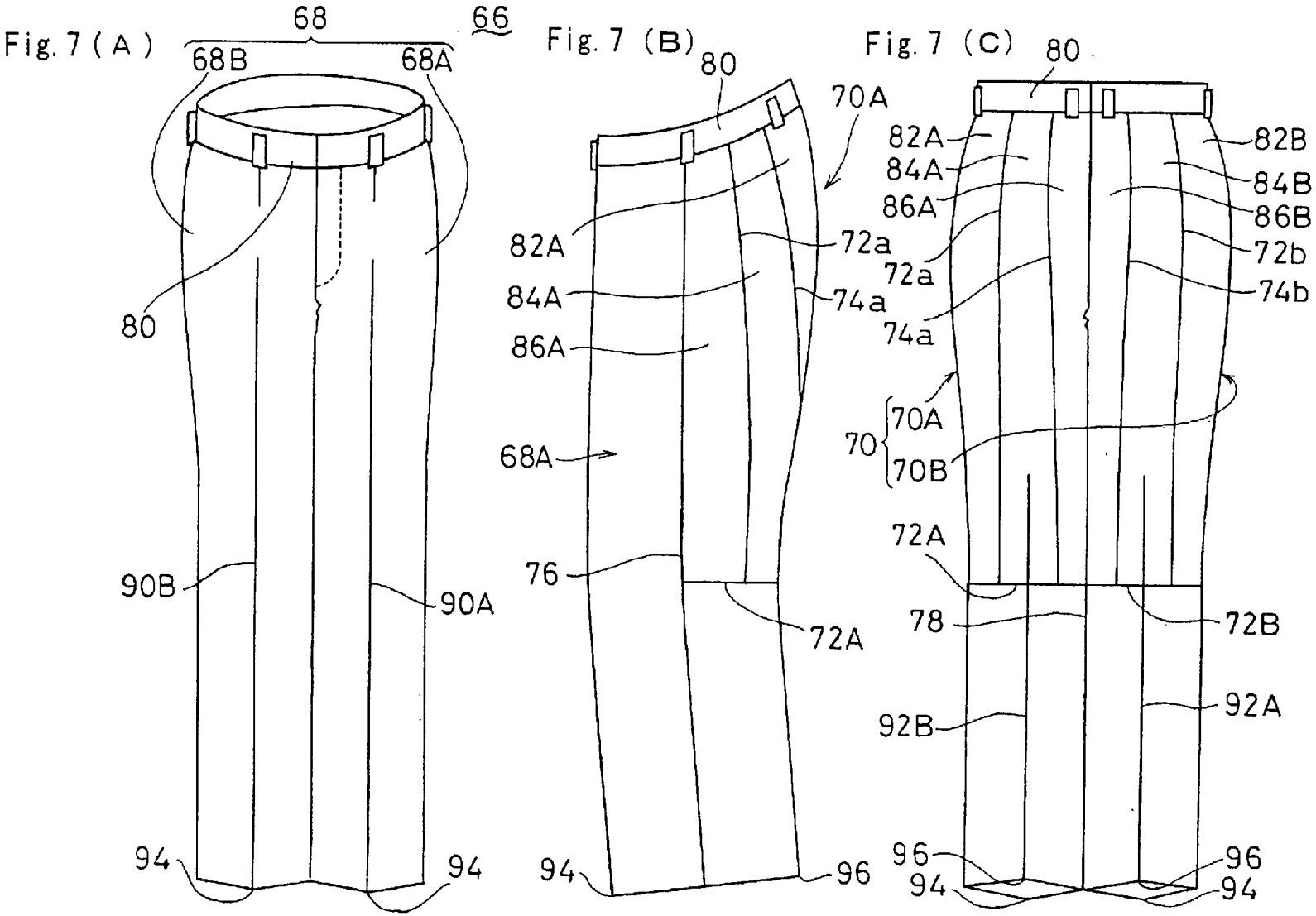
FIGS. 7A, 7B and 7C are diagrams showing an example of a pair of trousers according to a preferred embodiment of the present invention, where
Figure 8:
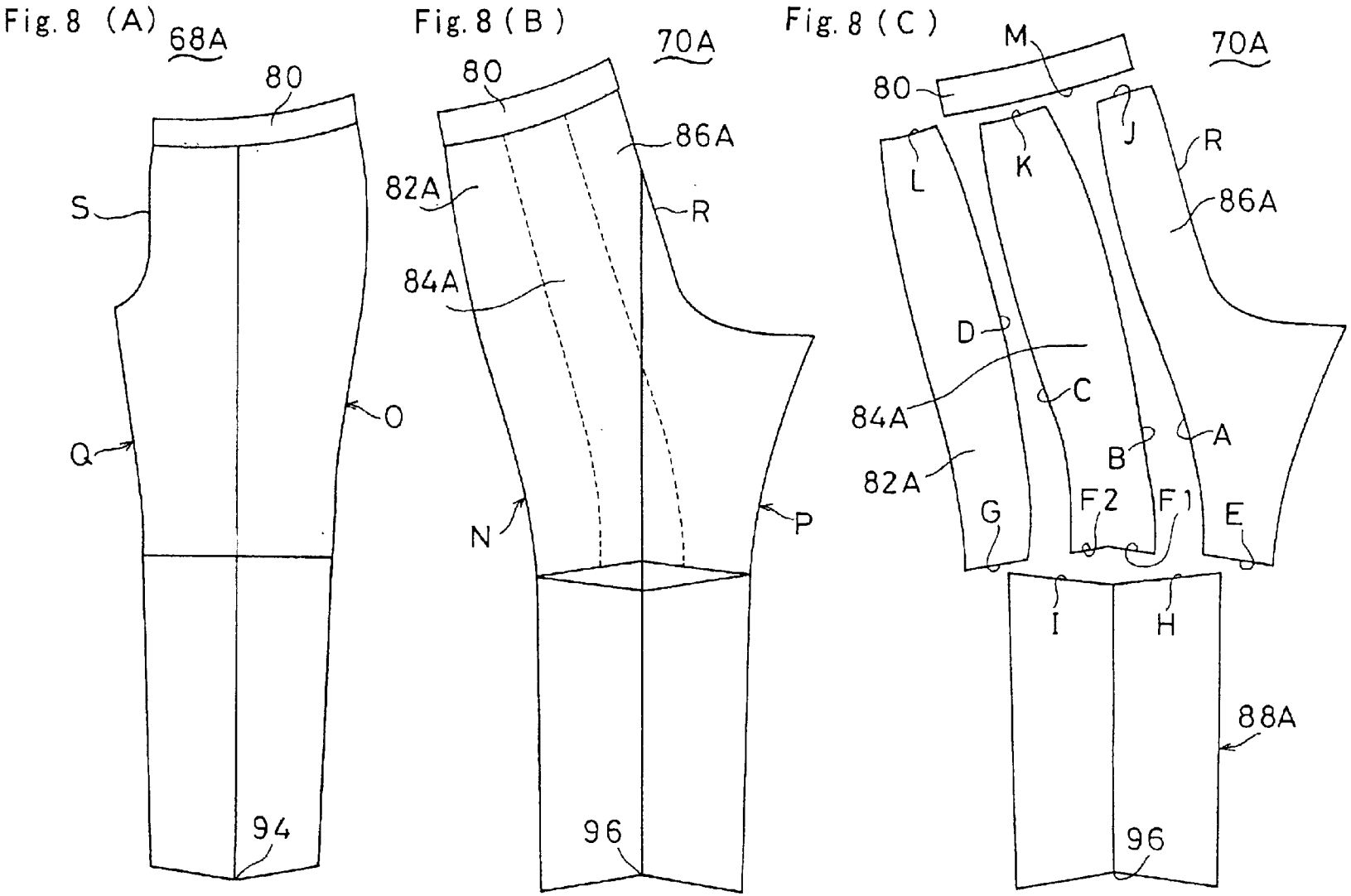
FIGS. 8A, 8B and 8C are development views showing a main part of fabric pieces constituting the trousers shown in FIGS. 7A, 7B and 7C, where
Figure 9:
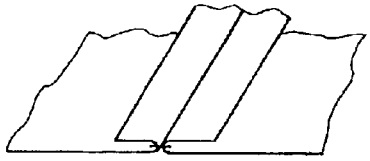
FIGS. 9A and 9B are diagrams showing an example of seam finishing of a cloth of the top and the trousers according to a preferred embodiment of the present invention, where
Figure 9:
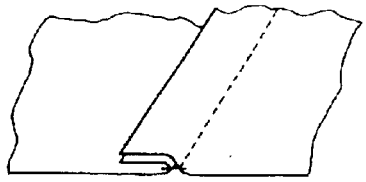
Figure 10:
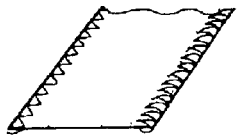
FIGS. 10A and 10B are diagrams showing an example of treating a cut edge of a cloth of the top and the trousers according to a preferred embodiment of the present invention, where
Figure 10:
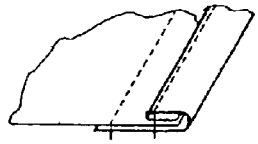
Figure 11:
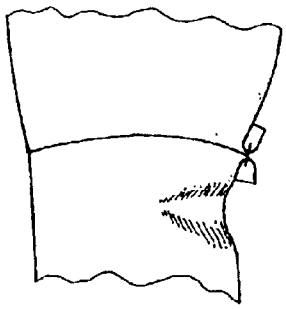
FIG. 11 is a diagram of a main part showing an example of contraction used for sewing the shoulders of the top and other portions according to a preferred embodiment of the present invention.

Next, a pair of trousers will be described with reference to FIGS. 7A to 8C and FIGS. 9A to 11. FIGS. 7A to 7C are diagrams showing an example of a pair of trousers according to a preferred embodiment of the present invention, where FIG. 7A is a front diagram, FIG. 7B is a left side diagram, and FIG. 7C is a back diagram thereof.

The business suit 10 according to this preferred embodiment includes a pair of trousers 66. The trousers 66 include a front body 68 and a back body 70. The front body 68 has, as shown in FIG. 7A, a front body 68A of a left half (hereinafter, referred to simply as the left front body 68A) and a front body 68B of a right half (hereinafter, referred to simply as the right front body 68B). The back body 70 has, as shown in FIG. 7C, a back body 70A of a left half (hereinafter, referred to simply as the left back body 70A) and a back body 70B of a right half (hereinafter, referred to simply as the right back body 70B).

The left back body 70A of the trousers 66 includes a knee portion dividing seam line 72A located at a position corresponding to the knee joint. The knee portion dividing seam line 72A serves to allow a knee portion of the left back body 70A to be bent while in the standing position. A part of the left back body 70A which is situated above the knee portion dividing seam line 72A is partitioned into a plurality of sections by curved joint lines 72*a* and 74*a*. In this case, the knee portion dividing seam line 72A is arranged so that one end thereof extends to a side seam 76 of the left back body 70A while the other end extends to an inseam 78 of the left back body 70A. The joint lines 72*a* and 74*a* are arranged so as to longitudinally extend from the knee portion dividing seam line 72A to reach a belt 80.

In this preferred embodiment, a part of the left back body 70A which is situated above the knee portion dividing seam line 72A is partitioned into, for example, three curved portions 82A, 84A and 86A by, for example, two curved joint lines 72*a* and 74*a*. Furthermore, in a part which is situated under the knee portion dividing seam line 72A, a left back body under knee portion 88A is preferably formed by a partition.

In a similar manner, the right back body 70B of the trousers 66 has a knee portion dividing seam line 72B and curved joint lines 72*b* and 74*b*. In a part of the right back body 70B which is situated above the knee portion dividing seam line 72B, three curved portions 82B, 84B and 86B are formed as shown in FIG. 7C. Furthermore, under the knee portion dividing seam line 72B, a right back body under knee portion 88B is preferably formed by a partition.

FIGS. 8A to 8C are main part development diagrams of fabric pieces constituting a left half (left body) of the trousers shown in FIGS. 7A to 7C. FIG. 8A is a diagram showing a fabric constituting a left half (left body) of the front body of the trousers, FIG. 8B is a diagram showing a fabric constituting a left half (left body) of the back body of the trousers, and FIG. 8C is an exploded view of FIG. 8B. Since a development view of fabric pieces constituting a right half of the front body and a right half of the back body in the trousers has line symmetry with respect to those of the left half of the front body and the back body shown in FIGS. 8A and 8B, the illustration and the description thereof are herein omitted.

The left half of the trousers 66 includes, as shown in FIGS. 8A to 8C, the left front body 68A and the left back body 70A, each of which is cut into a predetermined shape. Furthermore, the left back body 70A includes the three curved portions 82A, 84A and 86A, which are cut into a predetermined shape, and the left back body under knee portion 88A.

In the left back body 70A, a line A of the curved portion 86A and a line B of the curved portion 84A are joined to each other, whereas a line C of the curved portion 84A and a line D of the curved portion 82A are joined to each other. Furthermore, a line E of the curved portion 86A and a line F1 of the curved portion 84A are joined to a line H of the left back body under knee portion 88A, whereas a line F2 of the curved portion 84A and a line G of the curved portion 82A are joined to a line I of the left back body under knee portion 88A. Moreover, lines J, K and L of the curved portions 82A, 84A and 86A are joined to a line M of the belt 80. As a result, the left back body 70A as shown in FIG. 8B is provided.

In this preferred embodiment, in the left back body 70A, the line A of the curved portion 86A and the line B of the curved portion 84A are joined to each other to define the curved joint line 74*a* as shown in FIGS. 7 and 8A to 8C, whereas the line C of the curved portion 84A and the line D of the curved portion 82A are joined to each other to define the curved joint line 72*a*. In a similar manner, in the right back body 70B, the curved joint lines 72*b* and 74*b* are provided. The line E of the curved portion 86A and the line F1 of the curved portion 84A are joined to a line H of the left back body under knee portion 88A, whereas a line F2 of the curved portion 84A and a line G of the curved portion 82A are joined to a line I of the left back body under knee portion 88A, so as to define the knee portion dividing seam lines 72A and 72B shown in FIGS. 7B and 7C.

Furthermore, a line N of the left back body 70A and a line O of the left front body 68A are joined to each other to define a side seam 76, whereas a line P of the left back body 70A and a line Q of the left front body 68A are joined to each other to define an inseam 78. As shown in FIGS. 7A to 7C, lines 90A and 90B of the front body 68 define front creases, whereas lines 92A and 92B of the back body 70 define back creases. A line R of the left back body 70A defines a seam line between the left body and the right body (hip seam).

An example of a sewing method (sewing treatment) in the knee portion dividing seam lines 72A and 72B, the curved joint lines 72*a*, 74*a*, 72*b* and 74*b*, the knee portion dividing seam lines 72A and 72B, the side seam 76 and the inseam 78, for example, open seam as shown in FIG. 9A, or, for example, overlapped seam as shown in FIG. 9B is performed. As seam finishing of a cut edge, for example, as shown in FIG. 10A, zigzag seam may be performed by an overlock sewing machine.

As described above, in this preferred embodiment, for ease of bending the back knee, the back knee joint part is cut and the cut parts are sewn together to provide knee portion dividing seam lines 72A and 72B. At the same time, the front and the back of the trousers 66 when seen from the front creases 90A and 90B and the back creases 92A and 92B are formed by curved lines to eliminate the excess ease at the knee portions.

Moreover, around the buttock line, the sections obtained by three-dimensional cutting with the curved joint lines 72*a*, 74*a*, 72*b* and 74*b* are assembled to provide curved portions 82A, 84A, 86A, 82B, 84B and 86B having a paper balloon-like structure. As a result, the buttock line can have the desired fullness. Moreover, such a structure does not impair the esthetic values even while in the standing position.

In this preferred embodiment, as shown in FIGS. 7A to 7C and 8A to 8C, a line R of the hip seam of the trousers 66 is preferably slanted. At the same time, a back crotch length is longer than a line S of a front crotch length. Thus, the buttock line has further fullness. In this case, the belt 80 is formed in a curved line so as to form a high back crotch length. As a result, the trousers are more loosely tailored, allowing a comfortable sitting position to be achieved.

Furthermore, a hem front center 94 of the front body 68 of the trousers 66 is located under a hem back center 96 of the back body 70. More specifically, a hem of the trousers 66 has a reversed morning coat cut such that the front hem is cut long so that the front hem does not ride up.

In this preferred embodiment, a side pocket and a back pocket of the trousers 66 are preferably omitted. Therefore, the ventilation is improved in the regions where a side pocket and a back pocket would otherwise be provided and the vicinity thereof as compared with the case where these pockets are provided. At the same time, too tight of a fit of these regions to the body is prevented. Accordingly, even if a wearer sits in the wheelchair for a long time, pressure sores are reliably prevented.

Figure 19:
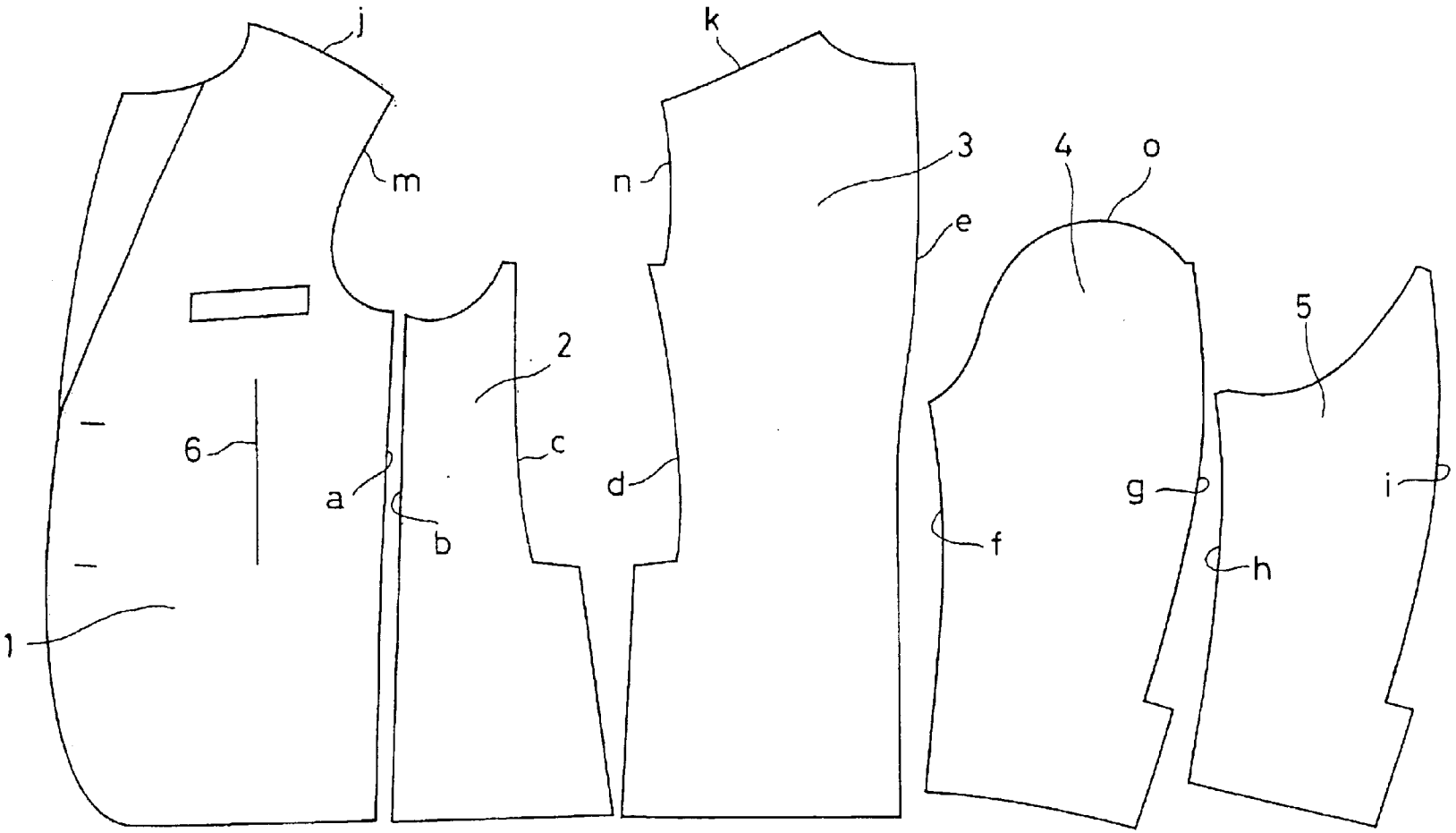
Fig. 19 PRIOR ART
FIG. 19 is a development view showing fabric pieces constituting a left half (left body) of a top of a conventional business suit, constituting the background of the present invention.

Since the back body 16 (back) is constituted by joining the fabrics at the positions of the back body center joint line 18, the left back body dividing seam line 2 and the right back body dividing seam line 26 in the top 12 of the suit 10 according to this preferred embodiment, the entire back body 16 (back) is constructed to have the desired roundness. Therefore, when a wearer of the top 12 of the suit 10 sits in the wheelchair, the roundness of the back is enveloped by the top 12, thereby providing great comfort to the wearer of the suit. Furthermore, since the top 12 has excellent movement functionality for responding to/following the movement of the elbows and the shoulders when a wearer operates the wheelchair, the tension in the back is reduced as compared with the case where a wearer is wearing a conventional suit as shown in FIGS. 19, 20A and 20B, thereby allowing a necessary amount of movement to be ensured. In particular, since parts of the left back body dividing seam line 22 and the right back body dividing seam line 26 are arranged so as to approximately run along the shoulder blades of a wearer in this preferred embodiment, the rotational movement of the elbows and the shoulders becomes smooth when a wearer operates the wheelchair.

Moreover, since the shoulder pads are omitted, the weight of the top is reduced. At the same time, the resistance against the movement of the shoulders when a wearer operates the wheelchair is reduced.

Furthermore, since the knee portion dividing seam lines 72A and 72B are provided in the back body 70 of the trousers 66 of the suit 10 according to this preferred embodiment, the knee portions of the back body 70 are in a bent state while in the standing position. Therefore, the excess ease of the knee portions can be eliminated when a wearer sits in the wheelchair. Moreover, since a part of the back body 70 situated above the knee portion dividing seam lines 72A and 72B is partitioned into a plurality of sections by the curved joint lines 72*a*, 74*a*, 72*b* and 74*b*, the three-dimensional space having paper balloon-like roundness can be ensured from the hipline to the buttock line. As a result, when a wearer sits in the wheelchair, the buttock line does not closely fit to the body, allowing a comfortable sitting position to be maintained.

Although two left back bodies, i.e., the first left back body 34*a* and the second left back body 36*a* are formed in the left back body 16A and two right back bodies, i.e., the first right back body 34*b* and the second right back body 36*b* are formed in the right back body 16B by two dividing seam lines, i.e., the left back body dividing seam line 22 and the right back body dividing seam line 26, two or more left back body dividing seam lines and right back body dividing seam lines may be formed in the left back body 16A and the right back body 16B, respectively.

In the trousers 66 according to the above-described preferred embodiment, a part of the back body 70 situated above the knee portion dividing seam lines 72A and 72B is preferably partitioned into six curved portions 82A, 84A, 86A, 82B, 84B and 86B by four curved joint lines 72*a*, 74*b*, 72*b* and 74*b*. However, three or more curved joint lines may be formed in each of the left back body 70A and the right back body 70B. Alternatively, only one curved joint line may be formed in each of the left back body 70A and the right back body 70B.

Furthermore, although both the side pocket and the back pocket are preferably omitted in the trousers 66 according to the above-described preferably embodiment, only one of these pockets may be omitted.

Figure 12:
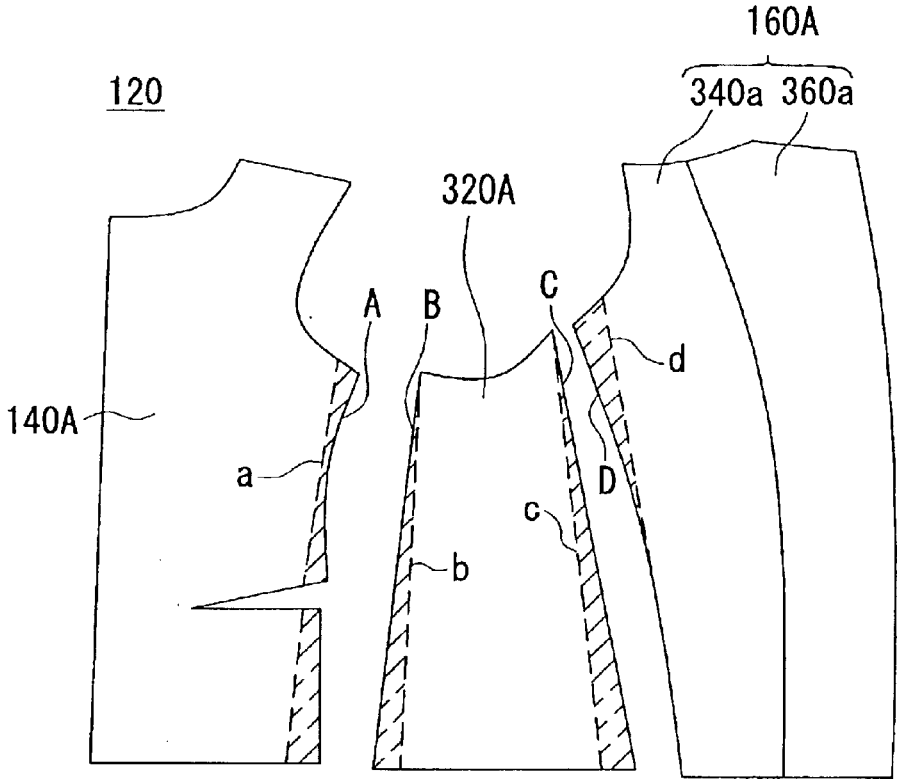
FIG. 12 is a development view of a main part showing an example of a top according to another preferred embodiment of the present invention.

FIG. 12 is a development view showing an example of a top according to another preferred embodiment of the present invention. A top 120 shown in FIG. 12 differs from the top described above particularly in that each of a left front body 140A, a left side body 320A and a first left back body 340*a* of a left back body 160A preferably has a large width. In this case, a portion of the front body 140A surrounded by a line A and a line a, a portion of the left side body 320A surrounded by a line B and line b, another portion of the left side body surrounded by a line C and a line c, and a portion of the first left back body 340*a* surrounded by a line D and a line d (each portion corresponding to a cross-hatched area in FIG. 12) are provided. Furthermore, although not shown in the drawing, each of a right front body, a right side body and a first right back body of a right back body constituting a right half (right body) of the top 120 also preferably has a relatively large width. As a result, the entire back body of the top 120 has a relatively large width. Therefore, for a wearer of the top 120, the top 120 has further reduced tension in the back portion and thus provides excellent movement functionality, providing great comfort for the wearer.

Figure 13:
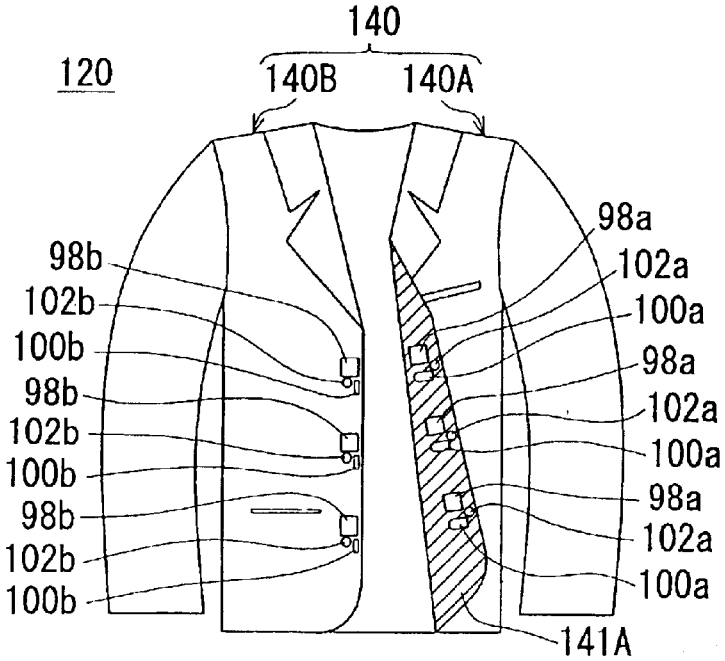
FIG. 13 is a front diagram of a main part, showing an example of a top according to a further preferred embodiment of the present invention.

FIG. 13 is a front diagram of a main part, showing an example of a top according to a further preferred embodiment of the present invention. The top 120 shown in FIG. 13 differs from the top 12 shown in FIGS. 1A and 1B particularly in that a left front body and a right front body of the top 120 can be closed and fastened by a hook and loop fastener, a snap, and a hook and eye. The top 12 shown in FIGS. 1A and 1B has a structure in which the button 64 sewn to the left front body 14A is fitted through a buttonhole (not shown) provided in the right front body 14B.

On the other hand, in the top 120 shown in FIG. 13, in a facing portion 141A on a back side of the left front body 140A, for example, three hook and loop fastener pieces 98*a* are provided at predetermined intervals in a direction along the edge of the facing portion 141A. On the right front body 140B, three hook and loop fastener pieces 98*b* are provided at the positions corresponding to the hook and loop fastener pieces 98*a*. Furthermore, a hook 100*a* having a substantially U-shaped cross section is provided in the vicinity of the lower side of each of the hook and fastener pieces 98*a*, whereas an eye 100*b* is provided in the vicinity of the lower side of each of the other hook and fastener pieces 98*b*.

Furthermore, a socket 102*a* of a snap is provided on the facing portion 141A on the back side of the left front body 140A so as to be situated slightly on the right side between each of the hook and loop fasteners 98*a* and each of the hooks 100*a*. On the right front body 140B, a ball 102*b* of the snap is provided at the position corresponding to the socket 102*a* of the snap.

In the top 120 shown in FIG. 13, the hook and loop fasteners 98*a* and the hook and loop fasteners 98*b* are engaged with each other to be fixed, and the hooks 10*a* and the eyes 100*b* are engaged with each other to be fixed. Furthermore, the sockets 102*a* and the balls 102*b* of the snaps are engaged with each other to be fixed so as to close and fasten the left front body 140A and the right front body 140B.

In this case, the hook and loop fasteners 98*a* and the hook and loop fasteners 98*b* are engaged with each other so as to provide an initial closure between the left front body 140A and the right front body 140B. Subsequently, the hooks 100*a* and the eyes 100*b* are engaged with each other. Then, the sockets 102*a* and the balls 102*b* of the snaps are engaged with each other, thereby providing a complete closure between the left front body 140A and the right front body 140B. More specifically, the left front body 140A and the right front body 140B are engaged with each other to be closed at three positions, that is, the hook and loop fasteners 98*a* and 98*b*, the hook 10*a* and the eye 100*b*, and the socket 102*a* and the ball 102*b* of the snap. As a result, the left front body 140A and the right front body 140B are not easily disengaged.

Although a button (not shown) can be optionally attached at a desired position on the surface side of the left front body 140A, the attachment of such a button is merely for ornamental purposes.

Figure 14:
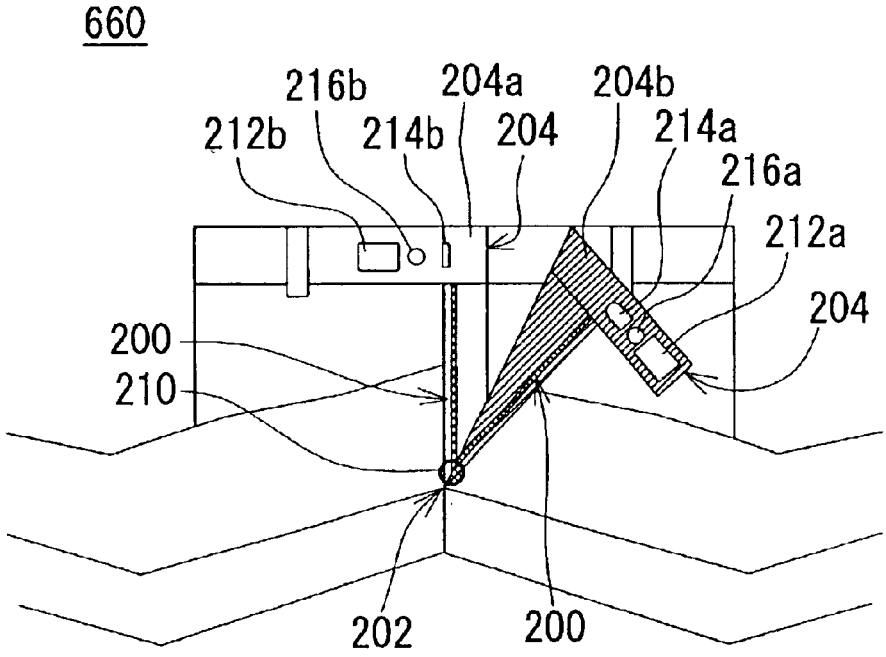
FIG. 14 is a front diagram of a main part, showing an example of a pair of trousers according to a still further preferred embodiment of the present invention.
Figure 15:
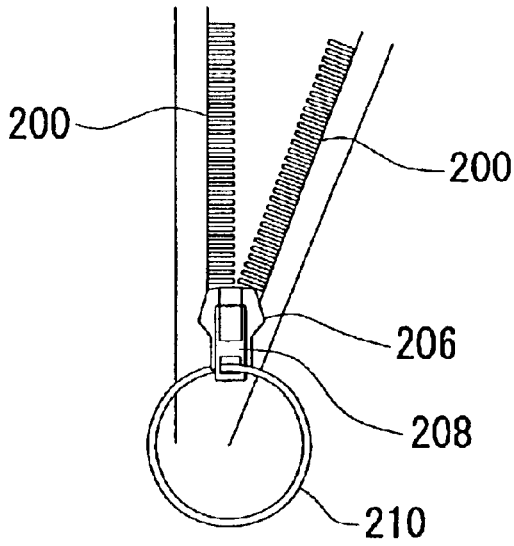
FIG. 15 is an enlarged view of a main part of FIG. 14.

FIG. 14 is a diagram of a main part showing an example of a pair of trousers according to a still further preferred embodiment of the present invention, and FIG. 15 is an enlarged view of a main part of FIG. 14. A pair of trousers 660 shown in FIG. 14 differ from the trousers 66 shown in FIGS. 7A and 7B particularly in that a fastener part 200 is long. In this case, the fastener part 200 is provided so that its one end extends to a crotch 202 and the other end extends to a waistband 204. Furthermore, in the fastener part 200, for example, a ring-shaped piece 210 having a substantially circular configuration is provided for a pull-tab 208 of a slider 206. The ring-shaped piece 210 preferably has a size that allows a wearer to easily pick the ring-shaped piece 210 with the fingers.

For example, one hook and loop fastener piece 212*a* is provided on a lining portion 204*b* of the waistband 204, whereas another hook and loop fastener piece 212*b* is provided at a position corresponding to the hook and loop fastener piece 212*a* on a top fabric portion 204*a* of the waistband 204. Furthermore, a hook 214*a* is provided on the lining portion 204*b* of the waistband 204 in the vicinity of the hook and loop fastener piece 212*a*, whereas an eye 214*b* is provided at the position corresponding to the hook 214*a* on the top fabric portion 204*a* of the waistband 204.

In the trousers 660 shown in FIG. 14, the hook and loop fastener piece 212*a* and the hook and loop fastener piece 212*b* are engaged with each other to be fixed, and moreover the hook 214*a* and the eye 214*b* are engaged with each other to be fixed so as to fasten the top fabric portion 204*a* and the lining portion 204*b* of the waistband 204.

In the preferred embodiment shown in FIG. 14, a socket 216*a* of a snap may be provided between the hook and loop fastener piece 212*a* and the hook 214*a* which are provided on the lining portion 204*b* of the waistband 204. Furthermore, a ball 216*b* of a snap, which is to be engaged with the socket 216*a* of the snap, may be provided between the hook and loop fastener piece 212*b* and the eye 214*b* on the top fabric portion 204*a* of the waistband 204. In this case, since the top fabric portion 204*a* and the lining portion 204*b* of the waistband 204 are engaged with each other to be closed at three positions, that is, the hook and loop fasteners 212*a* and 212*b*, the hook 214*a* and the eye 214*b*, and the socket 216*a* and the ball 216*b* of the snap, the top fabric portion 204*a* and the lining portion 204*b* of the waistband 204 are not easily disengaged.

In the trousers 660 shown in FIG. 14, the fastener part 200 is preferably long so that one end thereof reaches the crotch 202. Such a structure facilitates the urination of a wearer while in a seated position. Furthermore, since the ring-shaped piece 210 is provided for the pull-tab 208 of the slider 206, the slider 206 of the fastener part 200 can be easily pulled down to the lower end. Moreover, the front crotch length is reduced and the back crotch length is increased in the trousers 660 shown in FIG. 14 so as to reduce the excess fabric of the front body under the belt 204 as much as possible.

Figure 16:
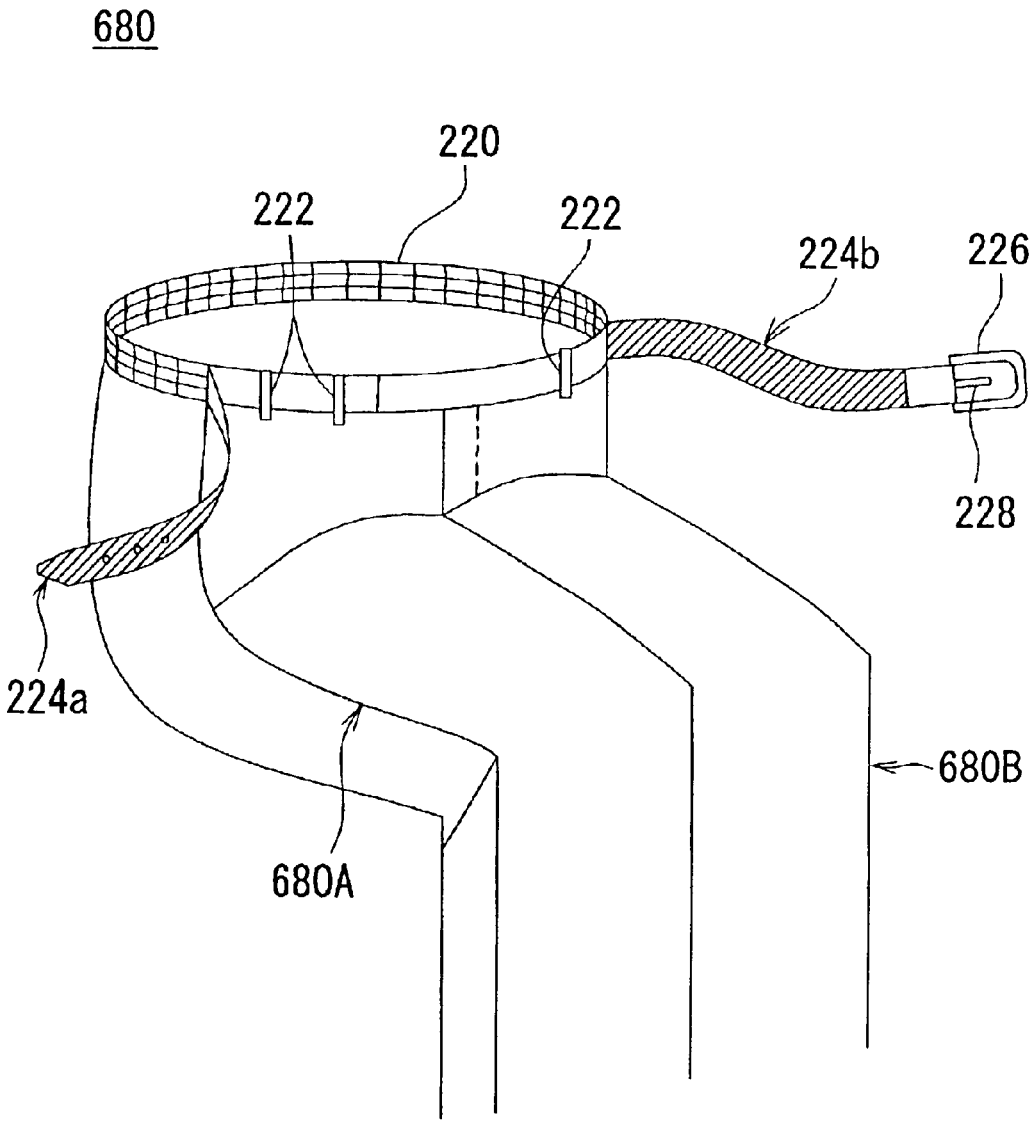
FIG. 16 is a diagram of a main part showing an example of a pair of trousers according to a still further preferred embodiment of the present invention.

FIG. 16 is a diagram of a main part showing an example of a pair of trousers according to a still further preferred embodiment of the present invention. A pair of trousers 680 shown in FIG. 16 differ from the trousers described above particularly in that a belt 224 is preferably sewn to a waistband 220. In this case, one end of one belt 224*a* is sewn to the vicinity of a portion where one side seam (seam line between a front body and a back body) 680A of the trousers 680 reaches the waistband 220. On the side of the other end of the belt 224*a* , punched holes are provided at predetermined intervals. One end of the other belt 224*b* is sewn to the vicinity of a portion where the other side seam (seam line between the front body and the back body) 680B of the trousers 680 reaches the waistband 220. On the side of the other end of the other belt 224*b*, a frame 226 of a buckle and a clasp 228 of the buckle are provided. Around the waistband 220, belt loops 222 for the belt 224 are provided at suitable intervals. In the trousers 680 shown in FIG. 16, the waistband 220, the belt 224*a*, the belt 224*b*, the frame 226 and the clasp 228 of the buckle, and the belt loops 222 are preferably made of a washable material.

Figure 17:
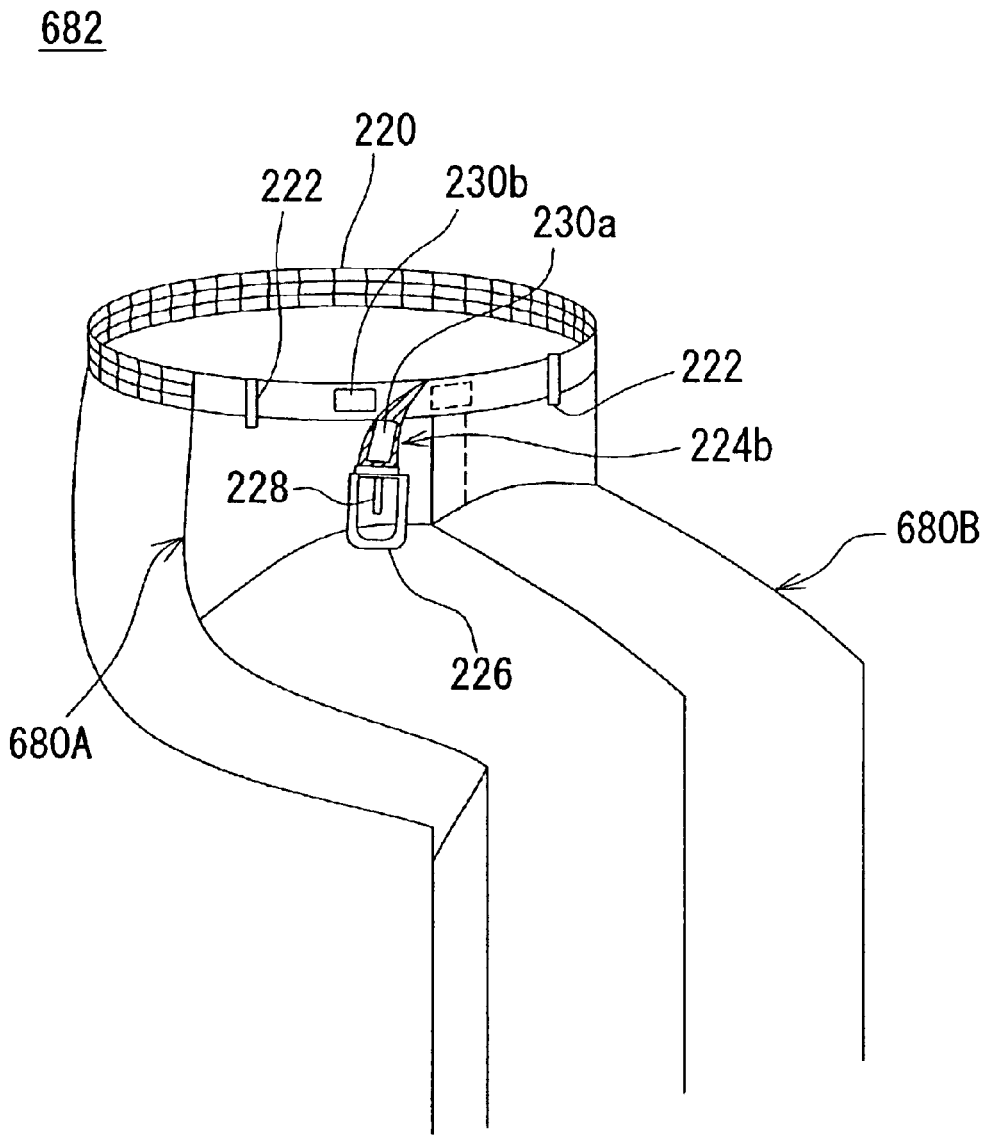
FIG. 17 is a diagram of a main part showing an example of a pair of trousers according to a still further preferred embodiment of the present invention.

FIG. 17 is a diagram of a main part showing an example of a pair of trousers according to a still further preferred embodiment of the present invention. A pair of trousers 682 shown in FIG. 17 differ from the trousers 680 shown in FIG. 16 particularly in that one of the belts 224*a* is omitted. Moreover, a hook and loop fastener piece 230*a* is provided on a back side of the other belt 224*b*. A hook and loop fastener 230*b*, which can be engaged with the hook and loop fastener piece 230*a* to be fixed, is provided on a top fabric portion of the waistband 220.

Figure 18:
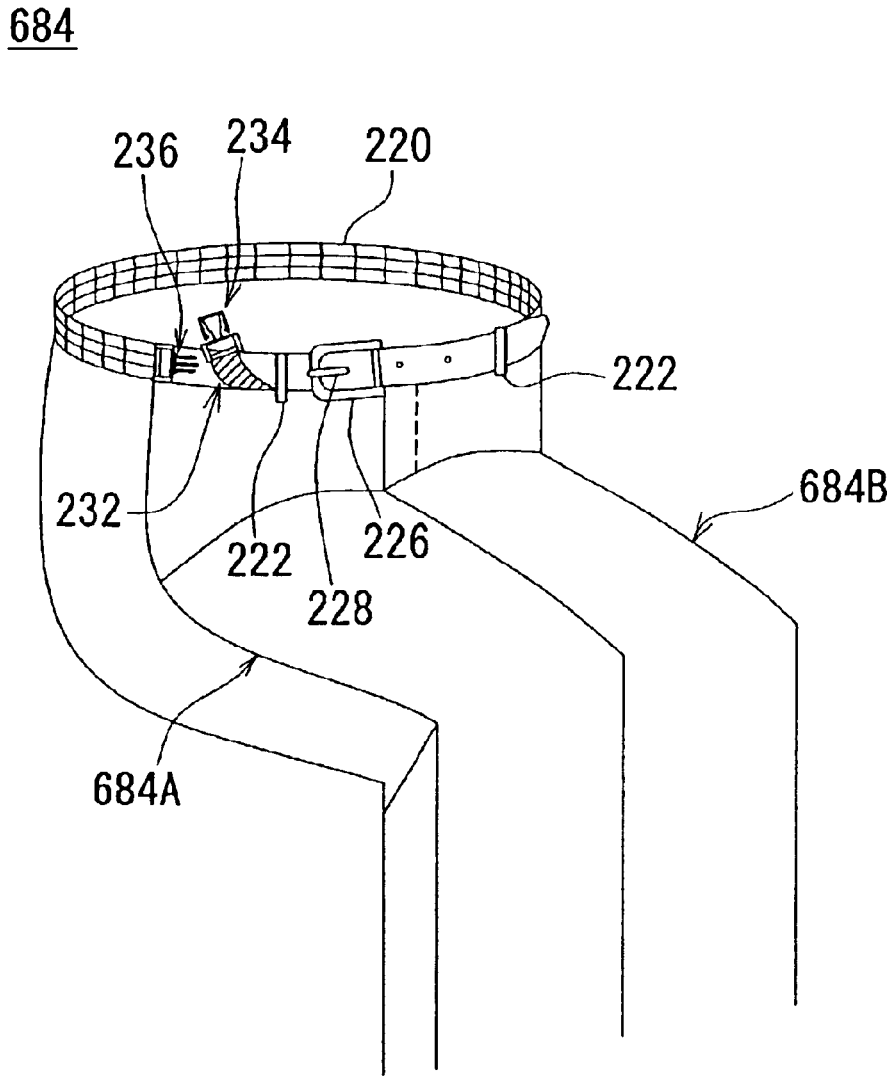
FIG. 18 is a diagram of a main part showing an example of a pair of trousers according to a still further preferred embodiment of the present invention.

FIG. 18 is a diagram of a main part showing an example of a pair of trousers according to a still further preferred embodiment of the present invention. A pair of trousers 684 shown in FIG. 18 differ from the trousers 680 shown in FIG. 16 particularly in that a belt 232 is provided so as to be attachable and removable to/from the waistband 220 of the trousers 684. More specifically, in the trousers 684 shown in FIG. 18, a snap type male buckle 234 is provided for each of the ends of the belt 232 in its longitudinal direction. For the waistband 220, snap type female buckles 236, which can be engaged with the snap type male buckles 234 to be fixed, are provided in the vicinity of a crossing point between a side seam (seam line between a front body and a back body) 684A of the trousers 684 and the waistband 220 and in the vicinity of a crossing point between the other side seam (seam line between the front body and the back body) 684B of the trousers 684 and the waistband 220, respectively. In FIG. 18, only one pair of the snap type male buckle 234 and the snap type female buckle 236 are shown by way of example.

In the preferred embodiment shown in FIG. 18, the belt 232 is attached to the waistband 220 by engagement of the snap type male buckle 234 and the snap type female buckle 236. However, the belt 232 may be attached to the waistband 220, for example, by buttons (not shown) instead of the snap type male buckle 234 and the snap type female buckle 236.

More specifically, buttonholes (not shown) are respectively provided on one end and the other end of the belt 232 in its longitudinal direction. For the waistband 220, buttons (not shown) are preferably provided at the positions corresponding to the buttonholes (not shown) of the belt 232. In this case, the belt loops 222 are provided on the back side of the trousers 684 from one side seam 684A and the other seam 684B, respectively. No belt loop 222 is provided on the front side of the waistband 220 from the side seams 684A and 684B.

Therefore, in wearing the trousers 684 of the preferred embodiment shown in FIG. 18, the buttons (not shown) of the belt 232 and the belt loops 222 are hardly visible from the front side, thereby providing an attractive appearance.

In the preferred embodiments shown in FIGS. 16, 17 and 18, an elastic band such as a rubber band is preferably provided between a top fabric and a waist cloth of the waistband 220 on the back side from the side seams 684A and 684B except for the back seam line so as to adjust the length around the waistline. A part of the waistband 220 situated on the back side from the side seams 684A and 684B may be formed of a stretchable material so as to provide a good fit for the hip line.

Moreover, in the preferred embodiments shown in FIGS. 17 and 18, the length around the waistline can be properly adjusted by providing an adjuster member on the back surface of the front side (waist cloth portion) of the waistband 220.

According to various preferred embodiments of the present invention, a suit providing excellent comfort in wearing and in the movement functionality when seated in a wheelchair is provided.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A suit comprising a pair of trousers including:

a back body; and a knee portion dividing seam line for allowing a knee portion of the back body to be bent while in a standing position and located at a position corresponding to a knee joint of the back body; wherein a part of the back body situated above the knee portion dividing seam line is partitioned into a plurality of sections by a curved joint line; and a number of the plurality of sections located above the knee portion dividing seam line is greater than a number of at least one section located below the knee portion dividing seam line.

2. The suit according to claim 1, wherein the part of the back body situated above the knee portion dividing seam line is partitioned into at least four sections by a plurality of joint lines.

3. The suit according to claim 1, wherein one end of the knee portion dividing seam line extends to a side seam of the back body and the other end of the knee portion dividing seam line extends to an inseam of the back body.

4. The suit according to claim 1, wherein a hip seam of the trousers is slanted and a back crotch length is longer then a front crotch length.

5. The suit according to claim 1, wherein a hem front center of the front body of the trousers is located under a hem back center of the back body.

6. The suit according to claim 1, wherein at least one of a side pocket and a back pocket is not provided.

7. The suit according to claim 1, wherein the trousers further include at least one of (1) hook and loop fasteners; (2) a hook and an eye; and (3) a ball and a socket of a snap.

8. The suit according to claim 1, wherein the trousers further include a fastener extending from a waistband to a crotch to facilitate urination of a wearer while in a seated position.

9. The suit according to claim 1, wherein the trousers further include at least one of a first belt portion attached to one side seam and a second belt portion attached to another side seam.

10. The suit according wherein the at least one of a first belt portion and a second belt portion are removably attached to the trousers.

* * * * *